United States Patent [19]

Sugioka

[11] Patent Number: 4,613,090

[45] Date of Patent: Sep. 23, 1986

[54] YARN WINDING APPARATUS OF AUTOMATIC BOBBIN CHANGING TYPE

[75] Inventor: Takami Sugioka, Matsuyama, Japan

[73] Assignee: Teijin Seiki Company Limited, Osaka, Japan

[21] Appl. No.: 705,627

[22] Filed: Feb. 26, 1985

[30] Foreign Application Priority Data

Mar. 2, 1984 [JP] Japan ..... 59-30406

[51] Int. Cl.[4] ..... B65H 67/048

[52] U.S. Cl. ..... 242/18 A

[58] Field of Search ..... 242/18 A, 18 DD, 18 PW, 242/18 R, 25 A, 56 A, 25 R

[56] References Cited

U.S. PATENT DOCUMENTS

| | | | |
|---|---|---|---|
| 3,165,274 | 1/1965 | DePriest | 242/18 A |
| 3,409,238 | 11/1968 | Campbell et al. | 242/18 A |
| 3,945,580 | 3/1976 | Veyrassat | 242/25 R X |
| 3,952,960 | 4/1976 | Veyrassat | 242/25 A |
| 4,327,872 | 5/1982 | Sachleben, Sr. et al. | 242/18 A |

FOREIGN PATENT DOCUMENTS

| | | | |
|---|---|---|---|
| 64148 | 5/1979 | Japan | 242/18 A |

*Primary Examiner*—Stanley N. Gilreath

*Attorney, Agent, or Firm*—Burgess, Ryan & Wayne

[57] ABSTRACT

A yarn winding apparatus of automatic bobbin changing type comprising:

a turret turnably mounted on a machine frame;

a plurality of bobbin holders which are rotatably supported on the turret and which receive bobbins;

the bobbin holders being alternately located at a yarn winding position where a yarn is wound onto one of the bobbins to form a full bobbin and at a doffing position where the full bobbin is doffed;

a plate separator which has a cross section of an arc of a circle and which is movable from a standby position located at a side of the bobbin holders to a separating position located between the yarn winding position and the doffing position;

a means for sliding the separator which is connected to the separator and which slides the separator in a lengthwise direction of the separator so that a front end of the separator moves across an imaginary line connecting centers of the bobbin holders.

6 Claims, 6 Drawing Figures

YARN WINDING APPARATUS OF AUTOMATIC BOBBIN CHANGING TYPE

BACKGROUND OF THE INVENTION

1. FIELD OF THE INVENTION

The present invention relates to a yarn winding apparatus of automatic bobbin changing type. More specifically, the present invention relates to an improvement of a yarn winding apparatus comprising a turret turnably mounted on a machine frame, a plurality of bobbin holders which are rotatably supported on the turret and which receive bobbins, and a separator which can be inserted into a space between the bobbin holders, whereby bobbins, onto which a yarn is wound, are automatically changed.

2. DESCRIPTION OF THE PRIOR ART

In a modern synthetic yarn manufacturing work, used is a yarn winding apparatus which comprises a turret turnably mounted on a machine frame and a plurality of bobbin holders which are rotatably supported on the turret and which receive bobbins.

When a predetermined amount of yarn is wound onto a bobbin to form a full bobbin, the turret is turned to replace the full bobbin with an empty bobbin and to continue the winding of the yarn onto the empty bobbin. The full bobbin is doffed from a bobbin holder, and then another empty bobbin is donned onto the bobbin holder.

In this case, there often may occur failure that a yarn end extending from the full bobbin entangles around the empty bobbin, after the turret has been turned. The occurrence of the above-described failure increases as the winding speed increases because a large amount of air flow accompanies the high speed rotation of the empty bobbin.

In order to obviate this failure, Japanese Utility Model Application Laid-open No. Sho 51-17550 discloses a method wherein compressed air is blown from outside toward the empty bobbin after the turret has been turned. However, such blowing of compressed air is insufficient to completely prevent the entanglement of the yarn around the empty bobbin, because the flow of the air accompanying the rotation of the empty bobbin increases as the winding speed increases. Furthermore, if this method is applied to a winding apparatus wherein a plurality of bobbins are inserted onto a spindle, the amount of consumed air becomes very large because air nozzles must be disposed for the respective bobbins, and accordingly, it is very difficult to practically use this method.

Japanese Patent Application Laid-open No. Sho 54-64148 discloses a method wherein a separator is inserted into a space between a full bobbin and an empty bobbin after a turret has been turned. However, the front end of the conventional separator disclosed in this Laid-open No. Sho 54-64148 merely reaches an imaginary line connecting the centers of the full bobbin and the empty bobbin. Accordingly, it is very difficult to obviate the influence of the air accompanying the rotation of the empty bobbin upon the full bobbin. Especially, when a yarn having a fine denier is wound, the yarn which is thin and light is easily involved in the influence of the accompanying air. Therefore, this method is insufficient to fully prevent the yarn end extending from the full bobbin from being entangled with the empty bobbin.

Japanese Patent Application Laid-open No. Sho 56-103558 discloses a method wherein the above-described two methods are simultaneously applied, however, this method still has both the defects caused by the above-described methods.

Furthermore, many mechanisms are proposed by which a separator is inserted into a space between bobbin holders. In these conventional mechanisms, a swing lever, one end of which is swingably supported, or a crank mechanism are usually used, and the separator is moved from outside to the space between the bobbin holders by swinging the swing lever or crank mechanism. Because of the mechanism, the distance, for which the separator is inserted into the space, is limited. Furthermore, the separator is slightly varied in a direction perpendicular to the advancing direction of the separator, i.e., along an imaginary line connecting the centers of the bobbin holders, because of the swinging mechanism. Because of these reasons, the separator cannot be fully inserted into the space between the bobbin holders.

SUMMARY OF THE INVENTION

An object of the present invention is to eliminate the above-described disadvantages inherent to the conventional yarn winding apparatuses of automatic bobbin changing type.

Another object of the present invention is to provide a yarn winding apparatus of automatic bobbin changing type, by which a separator can be deeply inserted into a space between bobbin holders and by which the entanglement of a yarn end extending from a full bobbin around an empty bobbin is sufficiently prevented from occurring.

Still another object of the present invention is to provide a yarn winding apparatus of automatic bobbin changing type, the air consumption of which is very small even if the apparatus is used for simultaneously winding a plurality of bobbins held on a spindle.

According to the present invention, the above-described objects are achieved by a yarn winding apparatus of automatic bobbin changing type comprising:

a turret turnably mounted on a machine frame;

a plurality of bobbin holders which are rotatably supported on the turret and which receive bobbins;

the bobbin holders being alternately located at a yarn winding position where a yarn is wound onto one of the bobbins to form a full bobbin and at a doffing position where the full bobbin is doffed;

a separator which is formed in a plate shape and which is movable from a standby position located at a side of the bobbin holders to a separating position located between the yarn winding position and the doffing position;

a means for sliding the separator which is connected to the separator and which slides the separator in a lengthwise direction of the separator so that a front end of the separator moves across an imaginary line connecting centers of the bobbin holders.

It is preferable that the separator is formed in a shape having a cross section of an arc of a circle, when a floor space wherein the winding apparatus of the present invention is installed is small, or when the already existing winding apparatus is reconstructed to carry out the present invention.

BRIEF DESCRIPTION OF THE DRAWINGS

Some preferred embodiments of the present invention will now be explained in detail with reference to the attached drawings, wherein.

DESCRIPTION OF THE PREFERRED EMBODIMENTS

Figure 1:
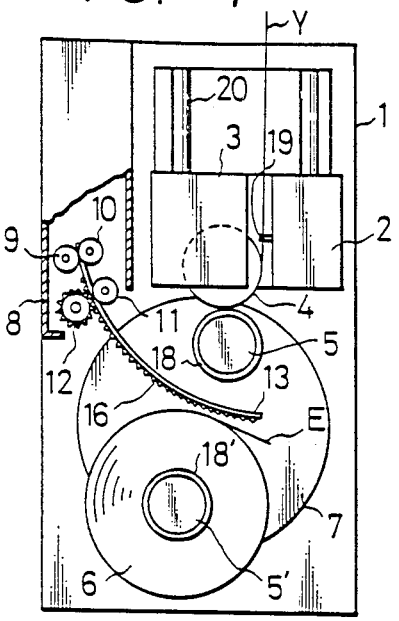
FIGS. 1 and 2 illustrate elevation views of the first embodiment of the present invention, and in FIG. 1, a separator is inserted into a separating position between a plurality of bobbin holders, while in FIG. 2, the separator is located at a standby position located at a side of the bobbin holders.
Figure 2:
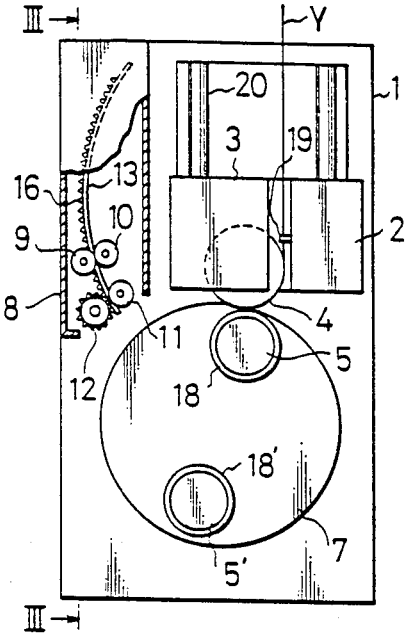

Referring to FIGS. 1 and 2, a slide block (not numbered) is vertically movable along two slide shafts 20 vertically disposed on a winding machine 1. The slide block has a traverse box 2 and a case 3 mounted thereon. The traverse box 2 is provided with a plurality of traverse guides 19, which move a plurality of yarns Y to and fro. The case 3 has a friction roller 4 rotatably mounted thereon.

The winding machine 1 has a turret 7 turnably mounted thereon, and the turret 7 has two bobbin holders 5 and 5' rotatably supported thereon. Bobbins 18 and 18' are inserted onto the respective bobbin holders 5 and 5'. The number of the bobbins 18 or 18' is equal to that of the traverse guide 19. The yarns Y are wound onto the bobbins 18 or 18' while they are traversed by the traverse guides 19.

A frame 8 of a box shape is disposed at the upper side of the slide block and is used to store a separator 13 therein. The separator 13 is made of a plate as illustrated in FIG. 3.

A separator slide mechanism is installed in the frame 8. More specifically, guide rollers 9, 10, and 11, and pinions 12 are rotatably mounted on the machine frame, and they guide the separator 13 in a lengthwise direction of the separator 13.

The separator 13 may be formed in such a manner that it has a cross section of a straight line. It is more preferable that the separator 13 is formed in such a manner that it has a cross section of an arc of a circle as illustrated in FIGS. 1 and 2. The curvature of the separator 13 is so selected that the separator 13 is formed in an arc of a circle which passes the separating position between the bobbin holders 5 and 5' and the standby position located at the upper side of the bobbin holders 5 and 5'.

Figure 3:
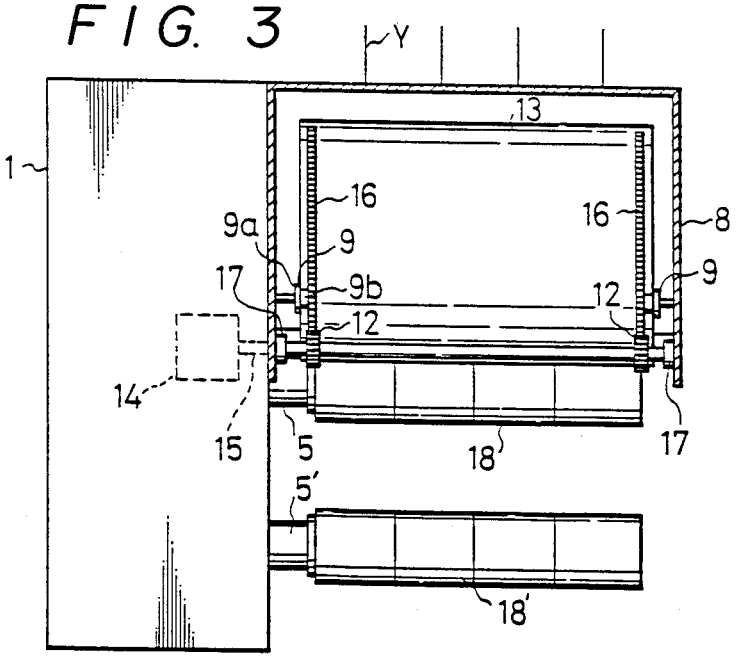
FIG. 3 illustrates a cross sectional view taken along line III—III in FIG. 2.

As illustrated in FIG. 3, a pair of racks 16 are integrally formed with the separator 13 or integrally attached to the separator 13 at the lower lateral edges of the separator 13, so that they extend in a lengthwise direction of the separator 13.

The pinions 12 are engaged with the racks 16 and are connected to a driving motor 14 via a shaft 15 supported by bearings 17, as illustrated in FIG. 3. The driving motor 14 may be an electric motor, or a pneumatic motor such as a rotary actuator.

The guide rollers 9 guide the edges of the separator 13 as illustrated in FIG. 3, and each of the guide rollers 9 consists of a flange portion **9*a* for preventing the lateral movement of the separator 13 and a guide portion 9*b* for cooperating with the guide rollers 10 to guide the separator 13. The guide rollers 9 and 10 sandwich the rear ends of the separator 13** to guide it.

When the pinions 12 are driven by the driving motor 14, the separator 13 is slid in a lengthwise direction thereof together with the racks 12 engaging with the pinions 12. As a result, the separator 13 reciprocates between the standby position located at the upper side of the bobbin holders 5 and 5' as illustrated in FIG. 2 and the separating position between the bobbin holders 5 and 5' as illustrated in FIG. 1.

During the normal winding operation, the separator 13 is retracted as illustrated in FIG. 2 and is stored in the frame 8.

When packages 6 which have been formed on the bobbins 18' inserted onto the bobbin holders 5' become full, the turret 7 is turned so that the empty bobbins 18 inserted onto the bobbin holders 5 are moved to a winding position to continue the winding of the yarns Y thereonto and so that the full bobbins 18' inserted onto the bobbin holders 5' are moved to the doffing position. As the turret 7 is turned, the yarns extending from the full bobbins 18' to the empty bobbins 18 are cut due to the increased tension in the yarns or by any appropriate yarn cutting means (not shown), and yarn ends E are formed.

Since the bobbin holders 5 rotate at a high speed, there occurs air flow accompanying the the rotation of the bobbin holders 5. If no special consideration is taken into, the accompanying air serves to suck the air around the full bobbins 18' to the empty bobbins 18, and as a result, the yarn ends E are entangled around the bobbin holder 5 or the bobbin 18 inserted thereon.

In order to obviate such entanglement of the yarn ends E, in the embodiment of the present invention illustrated in FIGS. 1 through 3, the pinions 12 are rotated by means of the driving motor 14 after the turret 7 has been turned, and the separator 13 is advanced by sliding the separator 13 in a lengthwise direction thereof together with the racks 16 engaging with the pinions 12.

The separator 13 is fully inserted into a space between the full bobbins 18' and the empty bobbins 18 and the front end of the separator 13 moves across the imaginary line connecting the centers of the bobbins 18 and 18' as illustrated in FIG. 1.

Accordingly, the separator 13 prevents the air flow between the full bobbin 18' and the empty bobbins 18 from occurring due to the suction force of the air accompanying the rotation of the empty bobbin 18. At the same time, a wall is formed by the separator 13 between the full bobbin 18' and the empty bobbins 18, and the yarn ends E are mechanically prevented from projecting across the wall. As a result, the yarn ends extending from the full bobbin 18' are prevented from entangling around the empty bobbin 18. Accordingly, the success ratio in bobbin changing operation is increased. This advantage is especially remarkable when a drawn yarn with a fine denier is wound at a high speed. Furthermore, according to the present invention, the entanglement of the yarn ends is prevented, and accordingly, deterioration of the obtained packages due to the inclusion of the yarn ends can be prevented.

Figure 4:
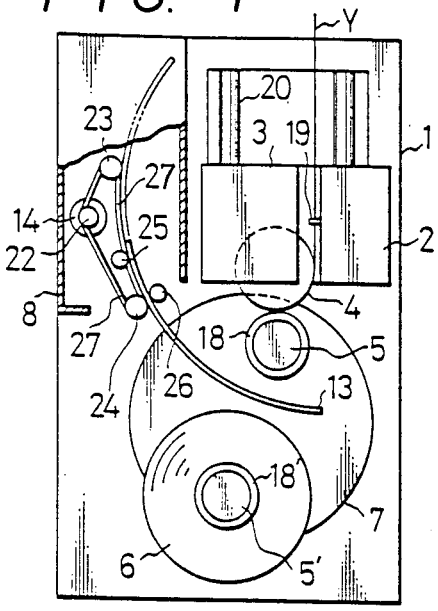
FIGS. 4, 5, and 6 illustrate elevation views of other embodiments, respectively.
Figure 5:
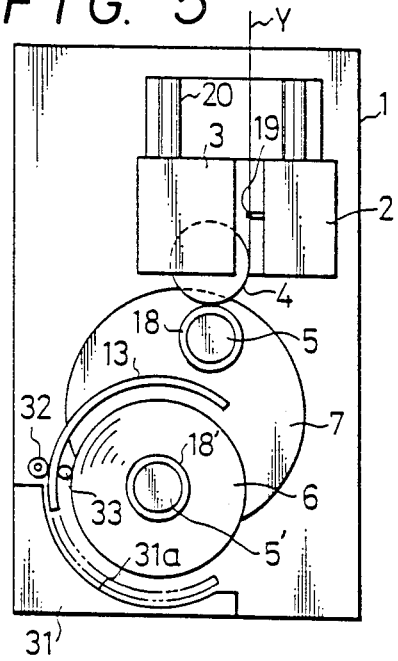
Figure 6:
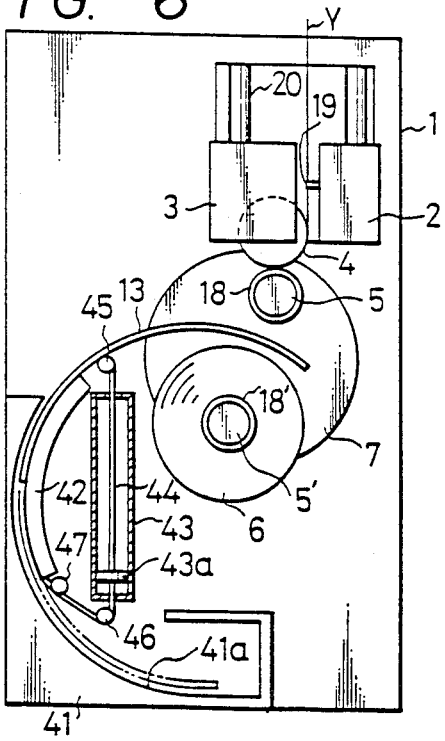

FIGS. 4 through 6 illustrate other embodiments of the present invention.

In the embodiment illustrated in FIG. 4, the separator slide mechanism is different from that explained above with reference to FIGS. 1 through 3. More specifically, in the above-explained embodiment, the separator slide mechanism comprises racks 16 disposed on the separator 13, pinions 12 disposed on the machine frame of the winding machine 1 and engaging with the racks 16, and a driving motor 14 for rotating the pinions 12. Contrary to this, in the embodiment illustrated in FIG. 4, the separator slide mechanism comprises an endless flexible driving member 27, such as a rope, a belt, or chains, connected to the separator 13, pulleys 22–25 disposed on the machine frame and engaging with the driving member 27, and a means for reciprocating the driving member 27.

In the embodiment illustrated in FIG. 4, the means for reciprocating the driving member 27 is a driving motor 14 which is connected to the pulley 22 and which rotates the pulley 22. A roller 26 is pressed toward the pulley 24, and it cooperates with the pulley 24 and guides the separator 13.

When the driving motor 14 is rotated, the separator 13 is slid in a lengthwise direction thereof and is moved from the standby position illustrated by a dot and a dash line in FIG. 4 to a position illustrated by a solid line across an imaginary line (not shown) connecting the centers of the full bobbin 18' and the empty bobbin 18.

Accordingly, the separator 13 prevents the air flow between the full bobbin 18' and the empty bobbins 18 from occurring due to the suction force of the air accompanying the rotation of the empty bobbin 18. At the same time, a wall is formed by the separator 13 between the full bobbin 18' and the empty bobbin 18, and the yarn ends E are mechanically prevented from projecting across the wall. As a result, the yarn ends extending from the full bobbin 18' are prevented from entangling around the empty bobbin 18. Accordingly, the success ratio in bobbin changing operation is increased. This advantage is especially remarkable when a drawn yarn with a fine denier is wound at a high speed. Furthermore, according to the present invention, the entanglement of the yarn ends is prevented, and accordingly, deterioration of the obtained packages due to the entanglement of the yarn ends can be prevented.

In the embodiment illustrated in FIG. 5, a frame 31 is formed at the lower side of the bobbin holders 5 and 5'. The frame 31 has a recess 31*a* formed in an arc of a circle, the curvature of which is almost the same as the curvature of the separator 13, and the recess 31*a* is used as a standby position. The separator slide mechanism in this embodiment comprises guide rollers 32 and 33 disposed on the machine frame of the winding machine 1 and sandwiching the separator 13, and a driving motor (not shown) for rotating one of the guide rollers 32 and 33.

In the embodiment illustrated in FIG. 6, a frame 41 has a curved track 41*a* which is formed similar to the recess 31*a* of the frame 31 illustrated in FIG. 5 and on which the separator 13 rides. In this embodiment, the mechanism for reciprocating the flexible driving member is different from that illustrated in FIG. 4. More specifically, in this embodiment, a flexible piston rod 44 is used as the flexible driving member and is connected to a piston 43*a* of a fluid pressure cylinder 43, which is sold under the name of "Cable Cylinder". The flexible piston rod 44 is wrapped around pulleys 45, 46 and 47 rotatably mounted on the machine frame 1 and the separator 13 rides on an opposing retaining plate 42.

In the above described embodiments, the present invention has been carried out in a friction type winding apparatus. However, the present invention is also applicable to a spindle drive type winding apparatus.

According to the present invention, the separator is slid in the lengthwise direction thereof, and accordingly, the stroke of the separator of the present invention can be large compared with conventional separators, wherein a swing lever or crank mechanism is used.

Furthermore, according to the present invention, the lateral movement of the separator can be minimized when the separator moves in the narrow space between the bobbin holders. Accordingly, the separator of the present invention can be deeply inserted across the imaginary line connecting the centers of the bobbin holders to a position far from the imaginary line.

As a result, according to the present invention, entanglement of the yarn end extending from the full bobbin around the empty bobbin can be substantially completely prevented from occurring. Since, no air blow toward the yarn end is used in the present invention, the air consumption can be minimized even if the present invention is applied to a winding apparatus wherein a plurality of bobbins are simultaneously inserted onto a spindle.

If the separator of the present invention is formed in a shape having a cross section of an arc of a circle which passes the separating position between the bobbin holders and the standby position located at the side of the bobbin holders, a floor space wherein the winding apparatus of the present invention is installed is minimized. Further, because the separator of this type minimizes the floor space, already existing winding apparatus can be readily reconstructed to carry out the present invention.

I claim:

1. A yarn winding apparatus of automatic bobbin changing type comprising:

a turret turnably mounted on a machine frame;

a plurality of bobbin holders which are rotatably supported on said turret and which receive bobbins;

said bobbin holders being alternately located at a yarn winding position where a yarn is wound onto one of said bobbins to form a full bobbin and at a doffing position where said full bobbin is doffed;

a separator which is formed in a plate shape having a cross-section of an arc of a circle and which is movable from a standby position located at a side of said bobbin holders to a separating position located between said yarn winding position and said doffing position;

means connected to said separator for sliding said separator in a lengthwise direction of said separator and about the axis of said arc of said separator so that a front end of said separator moves across an imaginary line connecting centers of said bobbin holders.

2. A yarn winding apparatus of automatic bobbin changing type according to claim 1, wherein said means for sliding said separator comprises a rack disposed on said separator, a pinion disposed on said machine frame and engaging with said rack, and a driving motor for rotating said pinion.

3. A yarn winding apparatus of automatic bobbin changing type according to claim 1, wherein said means for sliding said separator comprises an endless flexible driving member connected to said separator, a pulley disposed on said machine frame and engaging with said driving member, and a means for reciprocating said driving member.

4. A yarn winding apparatus of automatic bobbin changing type according to claim 3, wherein said means for reciprocating said driving member is a driving motor which is connected to said pulley so as to rotate said pulley.

5. A yarn winding apparatus of automatic bobbin changing type according to claim 3, wherein said means for reciprocating said driving member is a fluid pressure cylinder, a piston of which is connected to said driving member so as to reciprocate said driving member.

6. A yarn winding apparatus of automatic bobbin changing type according to claim 1, wherein said means for sliding said separator comprises guide rollers for sandwiching and guiding said separator therebetween, and a driving motor for rotating said guide rollers.

* * * * *